US008943617B2

(12) United States Patent
Harty

(10) Patent No.: US 8,943,617 B2
(45) Date of Patent: Feb. 3, 2015

(54) PROTECTIVE TEMPERATURE HELMET, PROTECTIVE TEMPERATURE HELMET LINER

(76) Inventor: Robert D. Harty, Mokena, IL (US)

( * ) Notice: Subject to any disclaimer, the term of this patent is extended or adjusted under 35 U.S.C. 154(b) by 281 days.

(21) Appl. No.: 13/354,202

(22) Filed: Jan. 19, 2012

(65) Prior Publication Data

US 2012/0210490 A1 Aug. 23, 2012

Related U.S. Application Data

(63) Continuation-in-part of application No. 12/982,621, filed on Dec. 30, 2010, now Pat. No. 8,468,613, which is a continuation of application No. 10/687,162, filed on Oct. 16, 2003, now Pat. No. 7,861,326.

(60) Provisional application No. 61/434,281, filed on Jan. 19, 2011.

(51) Int. Cl.

| | |
|---|---|
| ***A41D 13/00*** | (2006.01) |
| ***A42B 3/12*** | (2006.01) |
| ***A42B 3/28*** | (2006.01) |
| *A41D 13/05* | (2006.01) |

(52) U.S. Cl.

CPC ..... *A42B 3/121* (2013.01); *A42B 3/285* (2013.01); *A41D 13/0512* (2013.01)

USPC ..... 2/468

(58) Field of Classification Search

USPC ..... 2/413, 414, 7, 171.2, 181, 171.4, 181.6, 2/181.8, 182.1, 182.2, 182.3, 182.87, 468

See application file for complete search history.

(56) References Cited

U.S. PATENT DOCUMENTS

| | | | | |
|---|---|---|---|---|
| 4,130,902 | A * | 12/1978 | Mackenroth et al. | 2/7 |
| 4,133,055 | A * | 1/1979 | Zebuhr | 2/411 |
| 4,354,284 | A * | 10/1982 | Gooding | 2/413 |
| 4,854,319 | A * | 8/1989 | Tobin | 607/109 |
| 6,397,399 | B1 * | 6/2002 | Lampe et al. | 2/425 |
| 6,557,179 | B1 * | 5/2003 | Reuven | 2/171.2 |
| 6,625,820 | B1 * | 9/2003 | Lampe | 2/425 |
| 6,678,896 | B2 * | 1/2004 | Robinson et al. | 2/171.2 |
| 7,028,344 | B2 * | 4/2006 | Toth | 2/413 |
| 8,262,601 | B2 * | 9/2012 | Cumming et al. | 602/74 |

OTHER PUBLICATIONS

HTFx, Inc., Rite-Temp Medical Products, http://www.ritetempmedical.com/products.shtml (last visited Apr. 13, 2012).

* cited by examiner

*Primary Examiner* — Tejash Patel

(74) *Attorney, Agent, or Firm* — Cherskov Flaynik & Gurda, LLC

(57) ABSTRACT

The invention provides a head cooling/heating device comprising a webbing adapted to encapsulate the human head; and a plurality of cavities defined by said webbing, said cavities adapted to reversibly receive a plurality of substrates, wherein the substrates are capable of being cooled or heated.

19 Claims, 4 Drawing Sheets

PROTECTIVE TEMPERATURE HELMET, PROTECTIVE TEMPERATURE HELMET LINER

CROSS REFERENCE TO RELATED APPLICATIONS

This application claims the benefit of U.S. Provisional Patent Application No. 61/434,281 filed on Jan. 19, 2011, and as a continuation in part of U.S. patent application Ser. No. 12/982,621, filed on Dec. 30, 2010, currently pending the entirety of which is incorporated by reference, which in turn is a continuation application to U.S. patent application Ser. No. 10/687,182, filed on Oct. 16, 2003, and which issued as U.S. Pat. No. 7,861,326 on Jan. 4, 2011.

BACKGROUND OF THE INVENTION

1. Field of the Invention

This invention relates to a shock absorbing helmet liner which simultaneously keeps the wearer's head and neck and spine cool or warm, and more specifically, this invention relates to a device for regulating body temperature, for example by cooling the brain, reducing swelling on the brain, reducing the effects of hyperthermia, fever, while simultaneously preventing concussion injuries.

2. Background of the Invention

A majority of concussions sustained by persons involved in contact sports are the result not only of hard blows, but also from poor designs of the helmets and helmet liners.

The inventor's contention is that a leading contributor to concussions is heat. The brain, when subjected to sustained temperatures above 98.6 F, starts to swell. This is why the majority of the percentage of heat leaving the body in hyperthermia situations exits through the head, given its large vascularization.

There is only enough room between the brain and the cranium for an additional 10 cubic centimeters of fluid. That fluid space is easily taken up in high heat situations (such as what may occur during sustained physical exertion), either due to brain swelling, or brain bleeding, which is also the result of high heat scenarios.

In such scenarios, the brain not only contacts the cranium, but presses up against it. This makes the player incredibly prone to concussion inasmuch as the 10 cc of cushioning space mentioned supra is gone.

A need exists in the art for a device to cool the brain and upper spine while simultaneously protecting the brain from blows to the head. These two functions should be integrally molded into one feature of the device. The device should be worn alone, or else adapted to be worn with standard helmets or headgear so as to be removably received by the headgear. An embodiment of the device is integrally molded with a helmet such that the device may be worn as a stand-alone protective device. Finally, an embodiment of the device is used by itself without a helmet.

SUMMARY OF INVENTION

An object of the invention is to provide a device for preventing concussions that overcomes many of the disadvantages of the prior art.

Another object of the invention is to provide a device for preventing concussions to overheated players. A feature of the invention is the use of cooling substrates in conjunction with standard protective headgear. An advantage of the invention is that the substrates simultaneously serve to cool the brain and spine and cushion the brain from external blows to the head.

Yet another object of the present invention is to provide a means for preventing brain swelling due to heat. A feature of the invention the use of a plurality of cooling substrates received in regions of a helmet liner and or helmet. An advantage of invention is that the helmet liner is removably received by the overlying helmet. Another advantage is that the substrates can be separated from the helmet liner for prior refrigeration, or the substrates can remain in the helmet liner such that the entire liner can be refrigerated. The invented device also is adapted to being heated, to accommodate instances where the head requires heating.

Still another object of the present invention is to provide a combination head protection, head thermal-regulation device. A feature of the device is a stand alone, homogeneously constructed, shock-absorbing webbing adapted to be cooled or heated. An embodiment of the webbing includes means for receiving cooled or heated fluids while another embodiment is heated or cooled directly, without the need for first being filled with cooled or heated fluids. An advantage of the device is that no additional head protection is necessary, thereby conferring light weight, thermal management to the wearer's head, while also eliminating the physical shock associated with a rigid over-layment, such as a helmet, in instances of impact. The reversibly deformable, stand alone embodiment provides soft crumple zones to eliminate the aforementioned physical shock.

The invention provides a head cooling/heating device comprising a webbing adapted to encapsulate the human head; and a plurality of cavities defined by said webbing, said cavities adapted to reversibly receive a plurality of substrates, wherein the substrates are capable of being cooled or heated.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention provides a device for both cooling and cushioning the brain, both functions occurring simultaneously. Starting with a webbing akin to a loosely fitting swimming cap, the device also comprises material to cover the rear base of the skull and the cervical spine such that substantially all seven of the cervical vertebra are overlaid by the device.

An embodiment of the invention further comprises laterally positioned substrate situated on both sides of the neck. This laterally positioned substrate, when the device is worn, extends from the rear base of the skull to front of the neck. This laterally positioned substrate facilitates cooling of the lateral portions of the neck and particularly the carotid arteries found in the neck. Optionally, this embodiment includes downwardly depending substrate to overlay the cervical vertebrae of the user. This will downwardly depending substrate provides a means to prevent a depending end of a helmet from digging into the cervical spine in instances of whiplash.

Another embodiment of the invention comprises a stand alone helmet defining a two layer configuration. A first outer layer overlays a second layer and is more rigid, less rigid, or equally as pliable compared to the second layer. For example, an outer layer may be comprised of thermoplastic urethane (i.e., TPU cushioning). The second layer is either integrally molded to the first layer or else removably attached to the first layer. The second layer is adapted to receive cooled or heated free flowing fluid or else individual packets of cooled or heated fluid.

Figure 1:
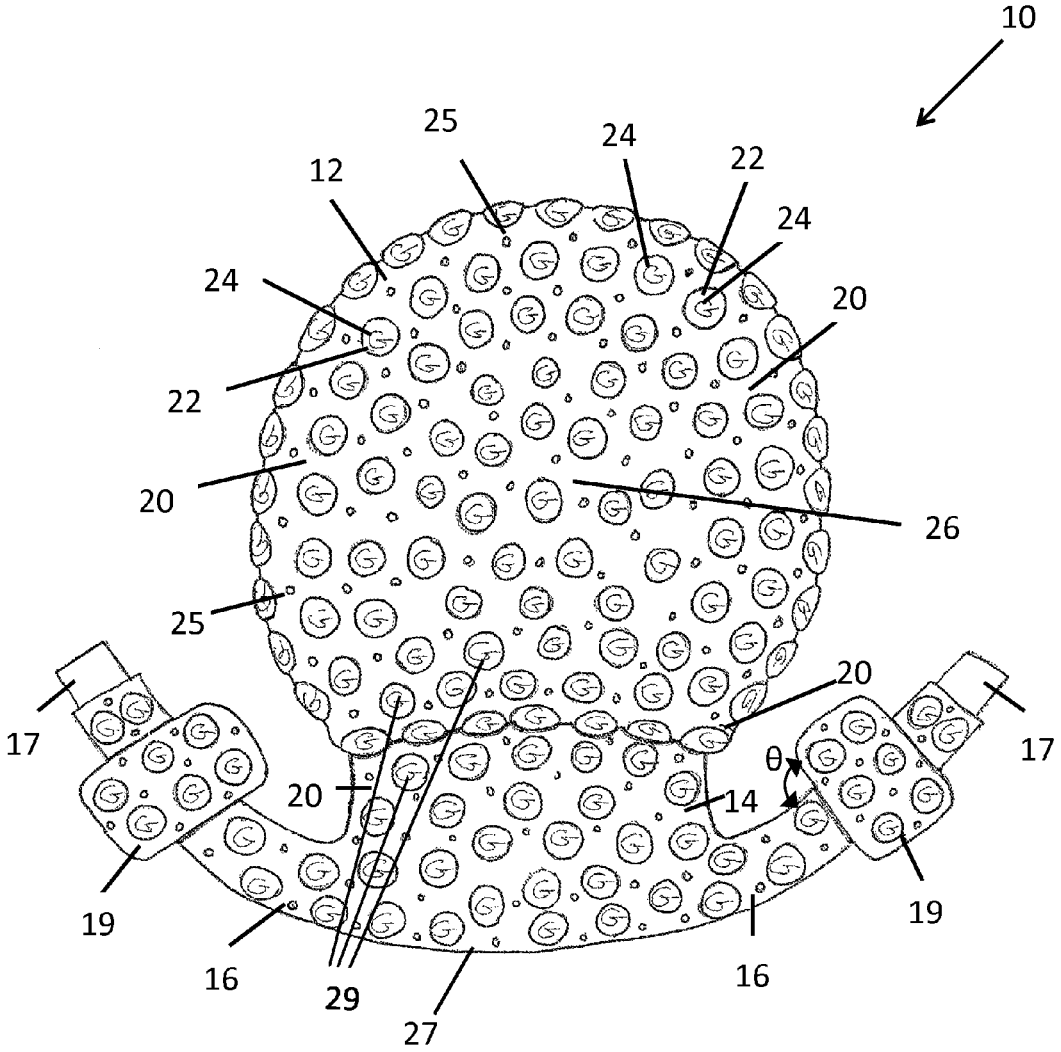
FIG. 1 is a plan view of a helmet liner, in accordance with features of the present invention.

FIG. 1 is a plan view of an embodiment of the invention, the device designated as numeral 10. Generally, the device 10 comprises three regions, a head cap region 12, a cervical cap region 14, and a carotid cap region 16. These three regions may be removably attached to each other, or integrally molded to each other. In the later iteration, a webbing 20 is used, the webbing defining individual pockets 22 adapted to removably receive cushioning substrates 24. Not all portions of the webbing need to be loaded with the cushioning substrates. For example, in one envisioned use, the top portion 26 of the webbing, which would overlay the trailing frontal and leading parietal portions of the skull, would not contain the cushioning substrates 24 while webbing overlying the trailing (i.e. dorsal) parietal region and the occipital and temporal regions of the skull would contain the cushioning substrate 24. This configuration may be beneficial for cyclists and other athletes more prone to whiplash, but less prone to intense physical contact from other players.

In another embodiment, the webbing covering all portions of the skull (i.e., frontal, parietal, occipital, temporal, sphenoid, and even the zygomatic and mandible regions) would be outfitted with cushioning substrates 24. Not only would overlying of the entire skull provide all encompassing shock protection thereto, but the temperature of the cushioning substrates 24 overlying the entire skull would optimize temperature regulation.

The webbing can define a myriad of different substrates. In one embodiment, as depicted in FIG. 1, portions of the webbing are continuous, while other portions define transversely extending apertures or vents 25. These vents provide a means for facilitating air exchange from areas between the head and the liner, and to areas outside or exterior of the liner. The vents 25 are shown dispersed throughout the webbing so as to be positioned over substantially all regions of the skull. However, the vents 25 can be relegated to specific regions of the cap such that all the vents are positioned over only selected regions of the skull, such as the parietal region, or the occipital region, or the temporal region or the frontal region of the skull, or the vents are positioned over a plurality of these regions but not all of the regions of the skull.

Figure 2:
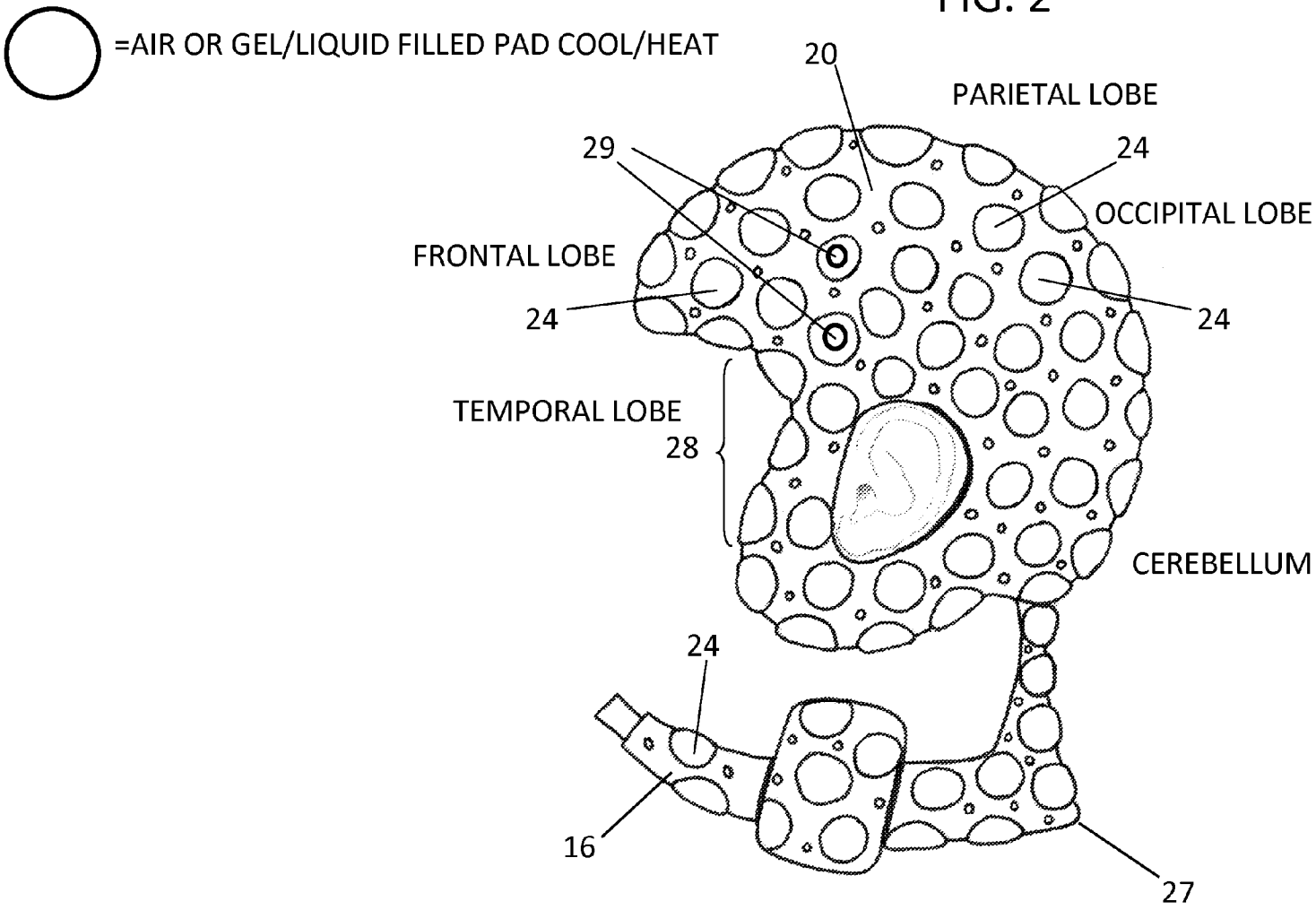
FIG. 2 is an elevated view of the invented helmet liner, in accordance with features of the present invention.

FIG. 2 is a side view of an embodiment of the invention in which all regions of the webbing contain the cushioning substrates 24. However, and as with vent placement, the cushioning substrates alternatively are positioned to cover only specific regions of the skull. The device also is adapted to receive cushioning substrates such that some of the substrates are at a temperature different than other cushioning substrates. This will allow areas of the skull to be cooled, while other areas of the skull to not be cooled (or cooled to a similar extent), while other areas may be heated.

Figure 3:
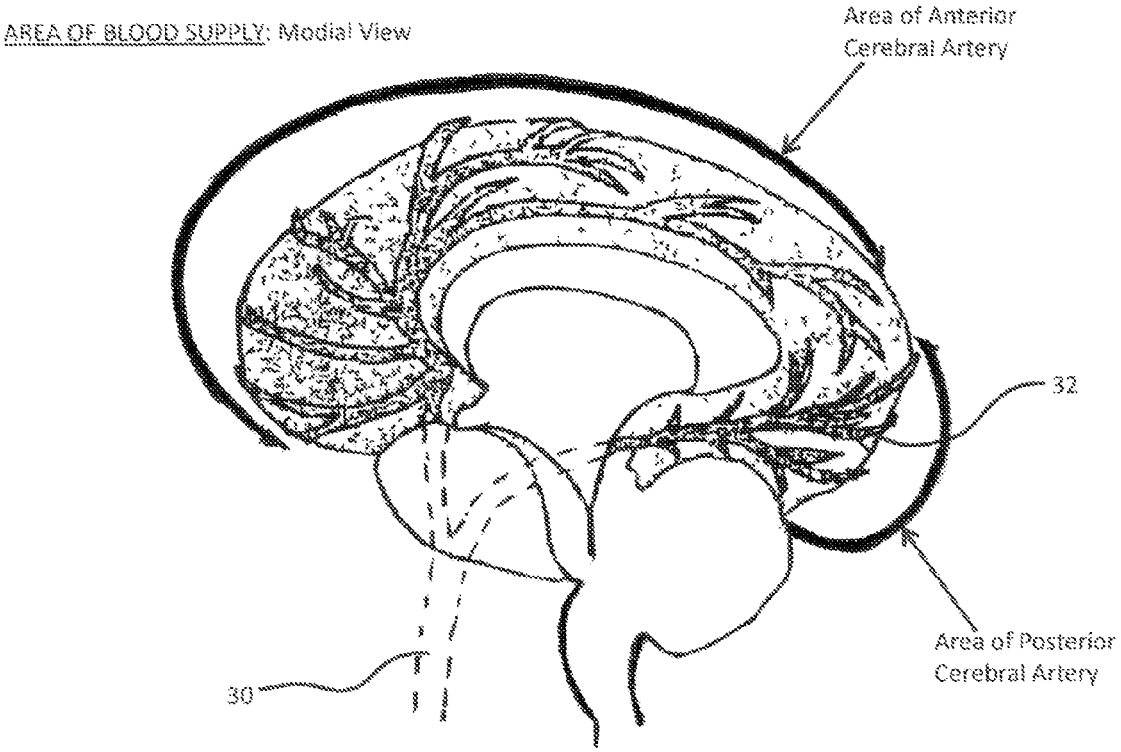
FIG. 3 is diagram showing blood flow through the head.

The invention allows placement of the cushioning substrate at strategic blood flow routes of the head. FIG. 3 is a view of the blood supply routes in the human brain. It is envisioned that cushioning substrate 24, preheated or precooled, are most effective when placed directly opposite these routes. For example, a plurality of chilled cushioning substrates 24 positioned along the temporal region 28 of the webbing would cool blood supplied by the carotid artery. Or, a plurality of chilled cushioning substrates 24 positioned along the base of the skull, so as to contact the occipital regions of the skull, would cool blood flowing through the posterior cerebral artery 32.

An embodiment of the invention includes one or more straps for contacting the medial and anterior portions of the wearer's neck. As shown in FIG. 1, two straps 16 are shown, with a means for attaching the distal ends 17 of the strap together at the front (anterior) of the neck. Also as shown in FIG. 1 are substrates 19 in slidable communication with the straps 16 and along the longitudinal axis of the straps. As such, a means for effecting this sliding communication is a slit in an outer membrane of the substrates, and parallel to the longitudinal axis of these substrates 19 adapted to slidably receive longitudinally extending portions of the straps. The longitudinal axis of these slidable substrates 19 are positioned at an angle theta to the longitudinal axis of the straps. As such, the angle theta (between about 0 and 90 degrees) provides a means for allowing the slidable substrate to confer additional cooling or heating treatment to areas beyond the periphery of the straps 16.

The cushioning substrates 24 may comprise a plurality of reversibly deformable substrates, such as plastic conduits or sacs, which may receive any suitable fluid such as air (for cushioning), a heated fluid (such as heated gas or heated liquid), a cooled fluid (such as cooled gas or cooled liquid), or a combination of such fluid phases and temperatures. Exemplary gaseous fluids include, but are not limited to, air, nitrogen, noble gases, and a combination of these. Exemplary liquid fluids include, but are not limited to, water, vegetable oil, mineral oil, liquid-solid combinations such as water-based deformable low density gel compositions, plasticizers with a plurality of particulates dispersed therein, deformable gel compositions comprising carbopol and water/glycerin, emulsions, and combinations of these substances.

Figure 4:
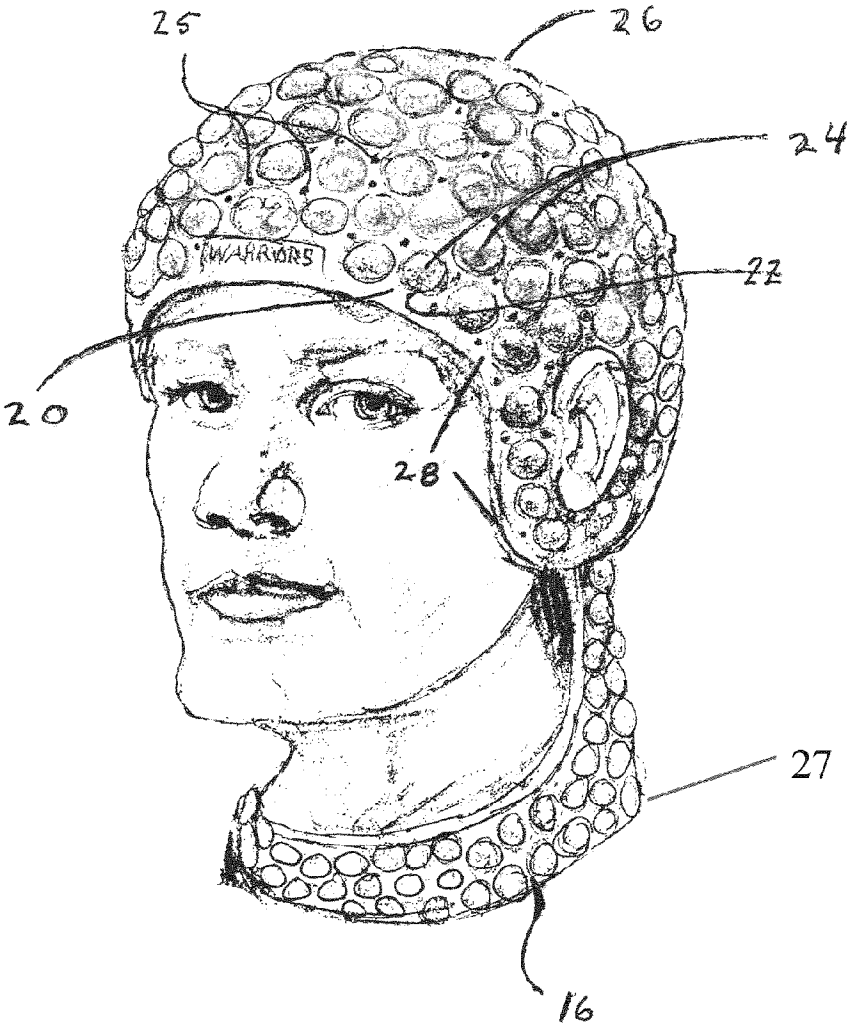
FIG. 4 is perspective view of an embodiment of the invention worn by a use, in accordance with features of the present invention.

FIG. 4 is a perspective view of an embodiment of the device in operation. This embodiment is shown being worn alone, i.e., without a helmet. It is noteworthy that a depending end 27 the embodiment extends at least to the base of the cervical spine, and as shown, slightly below the seventh vertebra.

To increase protection to the wearer, the cap is adapted to reversibly receive a semi-rigid, rigid, substrate such as a standard football helmet, cyclist helmet, baseball cap, or other typical sports head protective gear. Such sports head protective gear would substantially overlay the device. The semi-rigid or rigid substrate may also be low friction. Alternatively, a plastic/fiberglass/metal cap can be reversibly attached to this embodiment. This heterogeneously constructed (i.e. hybrid) embodiment not only would this confer rigid protection to the wearer, but it will also minimize friction if contact is made with another person.

It is to be understood that the above description is intended to be illustrative, and not restrictive. For example, all of the substrates, either the underlying liner, the stand alone embodiment, or the hybrid embodiment, are adapted to receive reflective material or printed material. Generally, the above-described embodiments (and/or aspects thereof) may be used in combination with each other. In addition, many modifications may be made to adapt a particular situation or material to the teachings of the invention without departing from its scope. For example, instead of a solid, one-piece helmet overlying the cooling/heating cap, a single rigid or semi-rigid material such as a disk 29 is attached or otherwise substantially overlays each of the single gel cushioning substrates 24, or a substantial number of the gel cushioning substrates in a predetermined area of the device. These single disks can either be removably attached (e.g., via a hook and pile attachment arrangement), or else permanently attached to their respective gel elements 24, either via adhesive, or integrally molded together. In the case of the disks being removably attached, this confers the ability for the user to personalize her headliner by selecting various colored disks.

Aside from being disk-shaped, the single substrates attached to a single gel element 24 can define a myriad of substantially two dimensional shapes, including squares, polygonals, and also three-dimensional shapes such as cubes, pyramids, or interlocking materials such that adjacent substrates matingly receive each other. Alternatively, these single substrates can vary in size and shape for use on the same device. These single substrates can be comprised of metal, plastic, glass, ceramic, fiberglass, carbon fiber composite, and combinations of these materials. Methods of production of these single substrates include 3-D printing, extrusion, drop forge, or solgel processing. These single substrates, as well as the constituents of other embodiments of the invention, can be thermally conductive, radio translucent, electrically insulative, water proof, or a combination of these features.

The single disk to gel pad configuration confers additional impact protection, just as a standard helmet does, but also allows for direct air exchange from the wearer-contact surface of the device, through the apertures 25, to the atmosphere. This disk-to-gel cushion configuration defines a flexible helmet with the advantages of a typical helmet and the advantages of full air exchange.

While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C.§112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A head and neck impact protection and thermal-regulation device comprising:

a. a webbing adapted to encapsulate the human head and neck;

b. a plurality of cavities defined by said webbing, said cavities adapted to reversibly receive a plurality of reversibly deformable substrates, wherein the substrates are capable of being cooled or heated;

c. wherein the webbing further defines apertures interspersed between the cavities to allow fluid exchange between the head and neck and the regions exterior to the webbing.

2. The device as recited in claim 1 wherein the webbing has a first inwardly facing surface that contacts the head and neck and a second outwardly facing surface that is in fluid communication with regions exterior of the webbing.

3. The device as recited in claim 1 wherein the substrates are reversibly deformable.

4. The device as recited in claim 3 wherein the substrates remain reversibly deformable after cooling or heating.

5. The device as recited in claim 1 wherein the webbing is absorbent.

6. The device as recited in claim 1 wherein the webbing is nonabsorbent.

7. The device as recited in claim 1 wherein the substrate are cooled or heated before being received by the cavities.

8. The device as recited in claim 1 wherein the substrates are cooled or heated while residing in the cavities.

9. The device as recited in claim 1 wherein the substrates are positioned in the cavities so as to lie in registration with major blood vessels of the head and neck.

10. The device as recited in claim 1 wherein the outwardly facing surface comprises temperature indicators.

11. The device as recited in claim 1 further comprising a semi-rigid or rigid material overlaying the webbing.

12. The device as recited in claim 11 wherein the material is reversibly attached to the webbing.

13. The device as recited in claim 11 wherein the material is integrally molded with the webbing.

14. The device as recited in claim 1 wherein the webbing has a first inwardly facing surface adapted to simultaneously contact the head, the front of the neck, the sides of the neck, and the back of the neck of a wearer.

15. The device as recited in claim 14 wherein the webbing is adapted to cool or heat substantially the entire cervical spine of the wearer.

16. The device as recited in claim 14 wherein the webbing extends to the base of the cervical spine of the wearer.

17. The device as recited in claim 1 wherein the device is adapted to receive a helmet.

18. The device as recited in claim 1 wherein the substrates provide impact resistance to the head and neck.

19. The device as recited in claim 1 wherein the substrates are removably received by the webbing.

* * * * *